US010522941B1

(12) United States Patent
Stackpole

(10) Patent No.: US 10,522,941 B1
(45) Date of Patent: Dec. 31, 2019

(54) WATERPROOF SINGLE-CONDUCTOR CONNECTION SYSTEM

(71) Applicant: OPENROV INC., Berkeley, CA (US)

(72) Inventor: Eric Stackpole, Berkeley, CA (US)

(73) Assignee: OPENROV INC., Berkeley, CA (US)

( * ) Notice: Subject to any disclaimer, the term of this patent is extended or adjusted under 35 U.S.C. 154(b) by 0 days.

(21) Appl. No.: 16/218,343

(22) Filed: Dec. 12, 2018

(51) Int. Cl.
*H01R 13/52* (2006.01)
*H01R 24/58* (2011.01)
*H01R 13/523* (2006.01)

(52) U.S. Cl.
CPC ..... *H01R 13/5221* (2013.01); *H01R 13/523* (2013.01); *H01R 24/58* (2013.01)

(58) Field of Classification Search
CPC ..... H01R 13/5221; H01R 13/5202; H01R 13/5219; H01R 13/523; H01R 13/5205; H01R 24/58; H01R 33/965
USPC ..... 439/271
See application file for complete search history.

(56) References Cited

U.S. PATENT DOCUMENTS 3,398,391 A * 8/1968 Brishka ..... H01R 13/5202 439/559
3,997,232 A * 12/1976 Dunaway ..... H01R 13/523 310/68 R
8,215,962 B1 7/2012 Machado
8,641,457 B2 * 2/2014 Watson ..... E21B 17/023 439/738
9,083,101 B2 * 7/2015 Watson ..... E21B 17/023
9,203,199 B2 12/2015 Brown
9,246,290 B1 1/2016 Hui et al.
9,300,101 B2 * 3/2016 Hayes ..... H01R 39/64
9,960,559 B2 5/2018 Pratt et al.
2013/0115784 A1 * 5/2013 Gobel ..... H01R 24/542 439/13
2014/0242825 A1 * 8/2014 Watson ..... E21B 17/023 439/275

* cited by examiner

*Primary Examiner* — Tulsidas C Patel
*Assistant Examiner* — Peter G Leigh
(74) *Attorney, Agent, or Firm* — Arc IP Law, PC; Joseph J. Mayo

(57) ABSTRACT

Connection system that provides robust, waterproof, high current capacity connections between cables and devices. Cables each contain a single conductive wire that terminates in a threaded rod. The threaded rod screws into a corresponding threaded hole in a receiving socket. Engagement of the threads provides a large contact surface area to support high current capacity and to provide a strong holding force to secure the connection. Cables terminate in a housing with an O-ring that forms a waterproof seal; the connection system can therefore be used for underwater connections. Right-handed and left-handed threads may be used on opposite ends of a cable so that tightening or loosening connections on both sides causes twists in the cable to cancel out. The connection system may include a hub with two busses that each have multiple connection points for cables. The hub may distribute power to connected devices and support inter-device communication.

14 Claims, 9 Drawing Sheets

WATERPROOF SINGLE-CONDUCTOR CONNECTION SYSTEM

BACKGROUND OF THE INVENTION

Field of the Invention

One or more embodiments of the invention are related to the field of electrical connectors. More particularly, but not by way of limitation, one or more embodiments of the invention enable a waterproof single-conductor connection system.

Description of the Related Art

A wide variety of electrical connectors are known in the art. Most are not suitable for underwater use. Connectors that are suitable for underwater use typically provide connections with multiple pins for the channels in a multi-wire cable, and one or more separate mechanisms to secure a connection and to prevent water entry into the multiple conductive channels. These mechanisms may include latches or screws to secure the connection, and various types of seals to prevent water entry. They also often use spring-loaded deflection to force pins against sockets to form a conductive path.

Connectors that screw together can form a strong connection; however, with multiple conductive paths a screw-on connection requires either that an outer screw-on connector shell rotate freely around the multiple pins and sockets, or that a complex series of rotating ring-type contacts be integrated into the connector. As a result, existing underwater electrical connection systems are often complex and expensive.

A connection option that is not known in the art is to simplify the connector design by limiting each cable to a single conductor, and to screw the conductive path directly into a receiving threaded conductive socket. A simple compressive seal may be added to make the connection waterproof. This solution may require multiple cables for multiple conductive paths, but it provides a very simple, robust, waterproof connection for each cable.

For at least the limitations described above there is a need for a waterproof single-conductor connection system.

BRIEF SUMMARY OF THE INVENTION

One or more embodiments described in the specification are related to a waterproof single-conductor connection system. Embodiments of the system enable cables to be connected to receiving devices or other sockets by screwing conductors together to form a single conductive path. No complex slip rings or freely rotating outer shells are required. No spring-loaded mechanisms are required to ensure electrical contact. Connections are simple, wet-mateable, robust, and capable of handling large amounts of current.

In one or more embodiments, the connector utilizes a conductive threaded rod protruding from an insulated housing which holds an O-ring used to insulate the threaded rod from water when the connector is in place. Electrical contact between the connector and its respective receptacle (a similarly threaded hole placed in a conductive material with an insulated casing) is made through the engagement of its threads with those in the hole. This engagement creates a sufficient amount of connecting surface area to allow for large amounts of current to be transferred between the two parts, and ensures electrical contact without the use of spring deflection required in most other types of electrical connectors.

One or more embodiments of the connection system may have one or more cables, each containing a single wire only. The middle section of each wire may be surrounded by a protective jacket coaxial with the wire; the jacket may be waterproof and electrically insulating. One or both ends of the wire may be attached to connectors. A connector may have a housing that is coupled to the jacket to form a waterproof seal. The housing may be coupled non-rotatably to the jacket with a waterproof joint, so that twisting the housing also twists the jacket. The housing may also be waterproof and electrically insulating. A threaded conductive rod may be inside the housing, with the threaded end extending from the connecting side of the housing. The threaded rod may be coupled non-rotatably to the housing, so that rotating the housing also rotates the threaded rod. The end of the wire inside the housing may be coupled inside the housing to the wire-facing side of the threaded rod. For example, the wire and the threaded rod may be soldered together. The coupling between the wire and the threaded rod may be non-rotatable. Rotation of the housing causes the threaded rod to turn, which also twists the wire and the jacket. The connecting end of the housing may have an O-ring or equivalent seal that surrounds the threaded rod extending outwards from the housing.

One or more embodiments of the connection system may have a receiver block to which a connector of a cable may be attached. The receiver block may have a conductive block with a threaded hole that mates with the threaded rod of the connector. An insulative layer may cover the conductive block with waterproof, electrically insulating material. The insulative layer may have a hole over the threaded hole in the conductive block. A cable may be attached to the receiver block by inserting the threaded rod of the cable connector into the threaded hole through the insulative layer, and by rotating the housing of the connector to screw the threaded rod into the threaded hole. This compresses the O-ring against the insulative layer, forming a waterproof seal.

In one or more embodiments, the conductive threaded rod may be attached to the receiver block instead of to the connector, and the threaded hole may be in the connector instead of in the conductive block. The conductive threaded rod may protrude from the conductive block of the receiver block through a hole in the insulative layer; it may be surrounded by an O-ring or equivalent seal that lies the insulative layer. A conductive threaded socket with a threaded hole may be inside the connector, and may be coupled to the wire inside the connector. This conductive threaded socket may be coupled non-rotatably to the housing of the connector, so that rotating the connector also rotates the conductive threaded socket. A cable may be attached to the receiver block by placing the inserting the threaded rod of the receiver block into the threaded hole of the connector, and by rotating the housing of the connector to screw the threaded rod into the threaded hole. This compresses the O-ring against the insulative layer and against the housing of the connector, forming a waterproof seal.

In one or more embodiments, all conductive elements of the system may be configured to transmit at least 4 amperes of current. This may include for example the wire, the threaded rod, and the conductive block of the receiver block.

In one or more embodiments, the wire jacket, the connector housing, the O-ring attached to the housing, and the insulative layer of the receiver block may be configured to provide protection against ingress of water when the system is submerged in water. Protection may for example prevent ingress of water to a depth of 100 meters or more.

In one or more embodiments, cables may have connectors on both ends of the cable. These connectors may both have housings, threaded rods, and O-rings as described above. They may differ in the handedness of the threads; for example, a connector on one side of the cable may have right-handed threads on its threaded rod, and the connector on the other side of the cable may have left-handed threads on its threaded rod. Using threads of opposite handedness prevents twist accumulation of the cable jacket or wire when both ends are screwed in or unscrewed. The housings of the two connectors on opposite ends of the cable may be marked or differentiated by color, shape, texture, or other features to identify the handedness of each end.

One or more embodiments of the connection system may include a hub into which multiple devices can be connected, using cables such as those described above. The hub may have two receiver blocks, each with a conductive block covered by a waterproof, electrically insulating insulative layer. Each conductive block may have multiple threaded holes, and corresponding holes in the insulative layer above those threaded holes. The threaded holes of one of the conductive blocks may be all right-handed, and the threaded holes of the other conductive block may be all left-handed. Conductive blocks of both receiver blocks may be configured to carry at least 4 amperes of current.

Multiple devices may be connected together using the hub, for example by connecting a pair of cables between the two receiver blocks of the hub and corresponding ports on the device. Each device may have two receiver blocks, with opposite handed threaded holes. Cables with opposite handed threaded connectors may be used to connect each device to the hub. For example, the right-handed connector of one cable may be connected to the right-handed receiver block of a device, and the left-handed connector of that cable may be connected to a hole in the left-handed receiver block of the hub. Similarly, the left-handed connector of a second cable may be connected to the left-handed receiver block of the device, and the right-handed connector of the second cable may be connected to a hole in the right-handed receiver block of the hub. A power supply, such as a battery, may be connected to the hub, and power may be transmitted from the power source to other devices connected to the hub. The hub and cables may also be used to transmit data among devices connected to the hub. For hubs that carry both power and data signals, a protocol such as HomePlug or Green PHY two-wire communications may be used to multiplex power and data over the channels.

BRIEF DESCRIPTION OF THE DRAWINGS

The above and other aspects, features and advantages of the invention will be more apparent from the following more particular description thereof, presented in conjunction with the following drawings wherein.

DETAILED DESCRIPTION OF THE INVENTION

A waterproof single-conductor connection system will now be described. In the following exemplary description numerous specific details are set forth in order to provide a more thorough understanding of embodiments of the invention. It will be apparent, however, to an artisan of ordinary skill that the present invention may be practiced without incorporating all aspects of the specific details described herein. In other instances, specific features, quantities, or measurements well known to those of ordinary skill in the art have not been described in detail so as not to obscure the invention. Readers should note that although examples of the invention are set forth herein, the claims, and the full scope of any equivalents, are what define the metes and bounds of the invention.

Figure 1A:
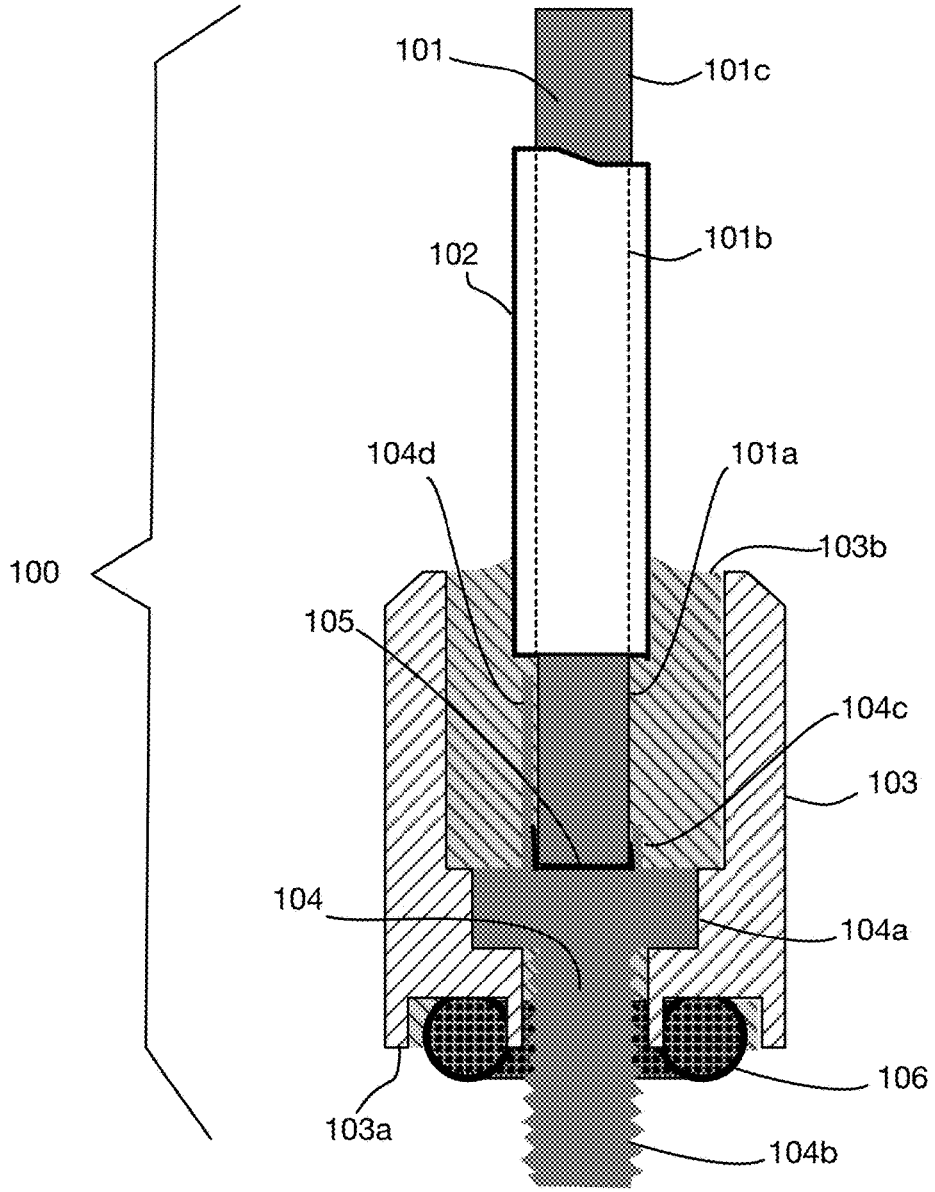
FIG. 1A shows a cross sectional view of an embodiment of a connection system with a connector that screws into a receiver block to form a waterproof connection for a single conductor.
Figure 1A:
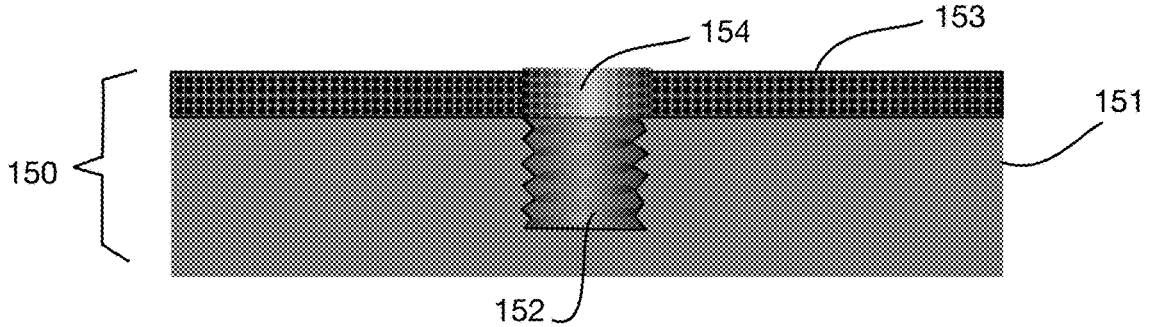

FIG. 1A shows an illustrative embodiment of a connection system that provides a robust, waterproof attachment mechanism between a cable 100 and a receiver block 150. The view shown is a cross sectional view through the cable, connector, and receiver block. The cable 100 terminates in a connector with a threaded conductive screw 104*b* that may be inserted and screwed into a corresponding threaded hole 152 in conductive material 151 in the receiver block 150. The cable 100 may be disconnected from receiver block 150 by unscrewing the screw 104*b* from threaded hole 152.

Cable 100 has a single conductive path through a single wire 101 that is connected within housing 103 to a conductive threaded rod 104 with head 104*a* and protruding threaded screw 104*b*. The shape of rod 104 shown in FIG. 1A is illustrative; in one or more embodiments the rod 104 may be of any size and shape. The rod 104 may have a head 104*a* of any size or shape, or it may have no separate head and may consist only of a threaded screw 104*b*. It may have any other features or protrusions in addition to head 104*a*. In one or more embodiments the rod 104 may consist of multiple components coupled together to form a conductive element. In one or more embodiments, the conductive path may be able to carry a large amount of current, for example 4 amps or more. This high current capacity is due in part to the unique design of the screw-in connector, which provides a high degree of contact between screw 104*b* and threaded hole 152. It is also due in part to limiting the cable to a single wire, which allows this single wire to be relatively thick without compromising cable flexibility. Because of the high current capacity of the cable and connection, the cable may be used to provide power to one or more devices, for example. The conductive path through the cable 100 and into the conductive material 151 of the receiver block is insulated by waterproof material and by the screw-in connection mechanism. The cable and receiver block may therefore be used underwater, for example.

Wire 101 may for example have three sections —a first end section 101*a*, a middle section 101*b*, and a second end section 101*c*. These sections may be physically contiguous portions of a single wire. The middle section 101*b* may be surrounded by a jacket 102 that may be substantially coaxial with the wire 101*b*; the jacket 102 may be waterproof and electrically insulating. The second end section 101*c* furthest from the screw 104*b* may be attached for example to another device, connector, panel, junction, or cable. Section 101*a* of the wire 101 may be inside housing 103, which also is waterproof and electrically insulating. Housing 103 has a wire-facing end 103*b* that is coupled to jacket 102. The coupling between the housing 103 and the jacket 102 may be waterproof, so that water cannot enter the housing from the wire-facing end 103*b* of the housing. The coupling is non-rotatably fixed, so that rotation of the housing to screw the connector into the receiver block also twists the jacket.

A threaded conductive rod 104 is also partially inside housing 103. The wire-facing end 104*a* of this rod is coupled to the first end section 101*a* of the wire, for example at joint 105. End 104*a* of the rod may for example fit into an indentation in the housing 103 which holds it in a fixed orientation relative to the housing. For example, without limitation, the wire-facing end 104*a* of the rod may be hexagonal, and it may fit into a corresponding hexagonal indentation in housing 103. In one or more embodiments, threaded rod 104 may be coupled to housing 103 with any type of fastener, such as glue, or by features in the housing that mate with features in the threaded rod to secure the rod in a fixed orientation relative to the housing. Rotation of housing 103 to attach the connector to the receiver block therefore also rotates the rod 104.

Wire-facing end 104*a* of rod 104 may be coupled non-rotatable to wire 101 at end 101*a* in any manner that provides a conductive path. For example, without limitation, wire end 101*a* may be soldered or crimped to end 104*a* of the rod. In one or more embodiments the wire and the threaded rod may be manufactured as a contiguous metallic element. In the illustrative embodiment shown in FIG. 1A, the wire-facing end 104*a* of the rod has a solder cup with sides 104*c* and 104*d*, and the wire is attached with solder 105 to the top of rod end 104*a* and to the solder cup sides 104*c* and 104*d*. The solder cup may for example increase the surface area of a soldered attachment, thereby improving conductivity and coupling strength, and it may keep the wire concentric with the rod.

Connecting end 104*b* of conductive rod 104 is threaded, and it extends beyond the end 103*a* of the housing. At the receiver-facing end 103*a* of the housing, an O-ring or equivalent seal 106 surrounds the end 104*b* of the threaded rod. This seal presses against the receiver block when the rod is inserted and attached, thereby forming a waterproof seal for the connection.

Receiver block 150 has a conductive block 151 with a threaded hole 152 that receives and mates with threaded rod end 104*b*. The side of the receiver block facing the cable 100 may include an insulative layer 153 that is waterproof and electrically insulating. This layer 153 has a hole 154 above the threaded hole 152.

Figure 1B:
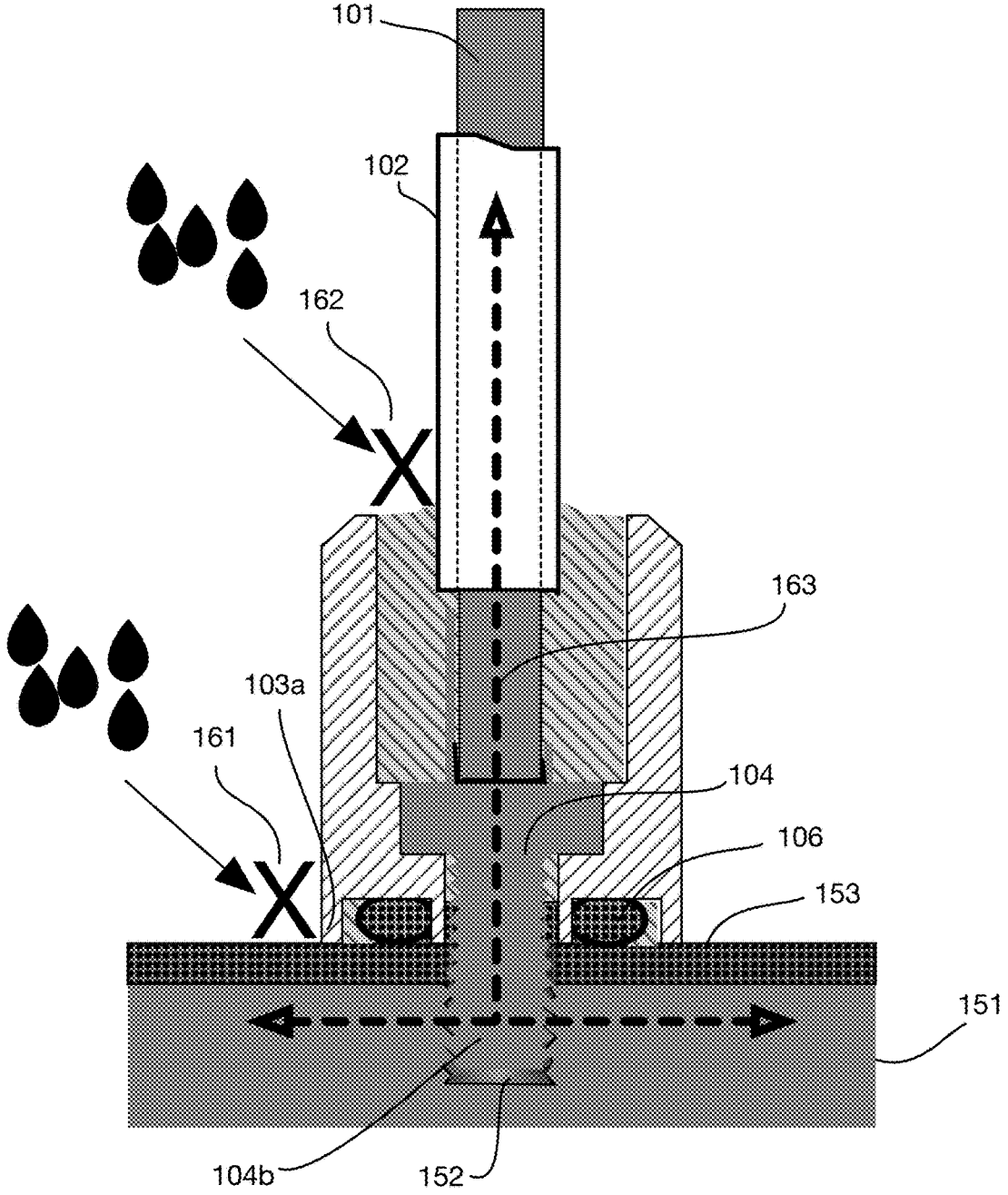
FIG. 1B shows a cross sectional view of the connection system of FIG. 1A with the connector attached to the receiver block.

FIG. 1B shows the embodiment of FIG. 1A with the connector attached to the receiver block. Threaded protrusion 104*b* of the threaded rod is screwed into threaded hole 152, forming a secure, robust, detachable, conductive connection. This conductive connection occurs directly when the conductive threaded rod is screwed into the conductive block; no spring-loaded mechanism is needed to push the conductive elements together, unlike many other connection systems. The engagement of the threads of 104*b* with the corresponding threads of hole 152 provides a large surface area for the connection, increasing conductivity of the path. The threads also provide a robust connection that stays in place even if significant forces act to pull apart the cable and the receiver block. Screwing the connection together compresses O-ring or other seal 106 against the insulative layer 153 of the receiver block, forming a waterproof connection. In one or more embodiments the insulative layer 153 may also be compliant to improve the seal. In one or more embodiments the end 103*a* of the housing may also press against the insulative layer 153, providing an additional sealing mechanism. The connector may be rotated until the end 103*a* of the housing contacts the insulative layer 153; this may for example inform a user rotating the housing that the connection is complete and is secure. The connection between the cable and the receiver block is waterproof at the junction 161 between the connector and the receiver, due to the housing, the O-ring, or both; the junction 162 between the housing and the jacket 102 is also waterproof. The connection therefore provides a waterproof conductive path 163 between the conductive block 151 and the wire 101, through the threaded rod 104 of the connector. In one or more embodiments the waterproof seals are sufficiently strong to provide protection against water when the cable and receiver block are submerged to a depth of 100 meters or more. The components may be disconnected by reversing rotation of the housing to unscrew the threaded rod 104*b* from threaded hole 152.

Figure 2:
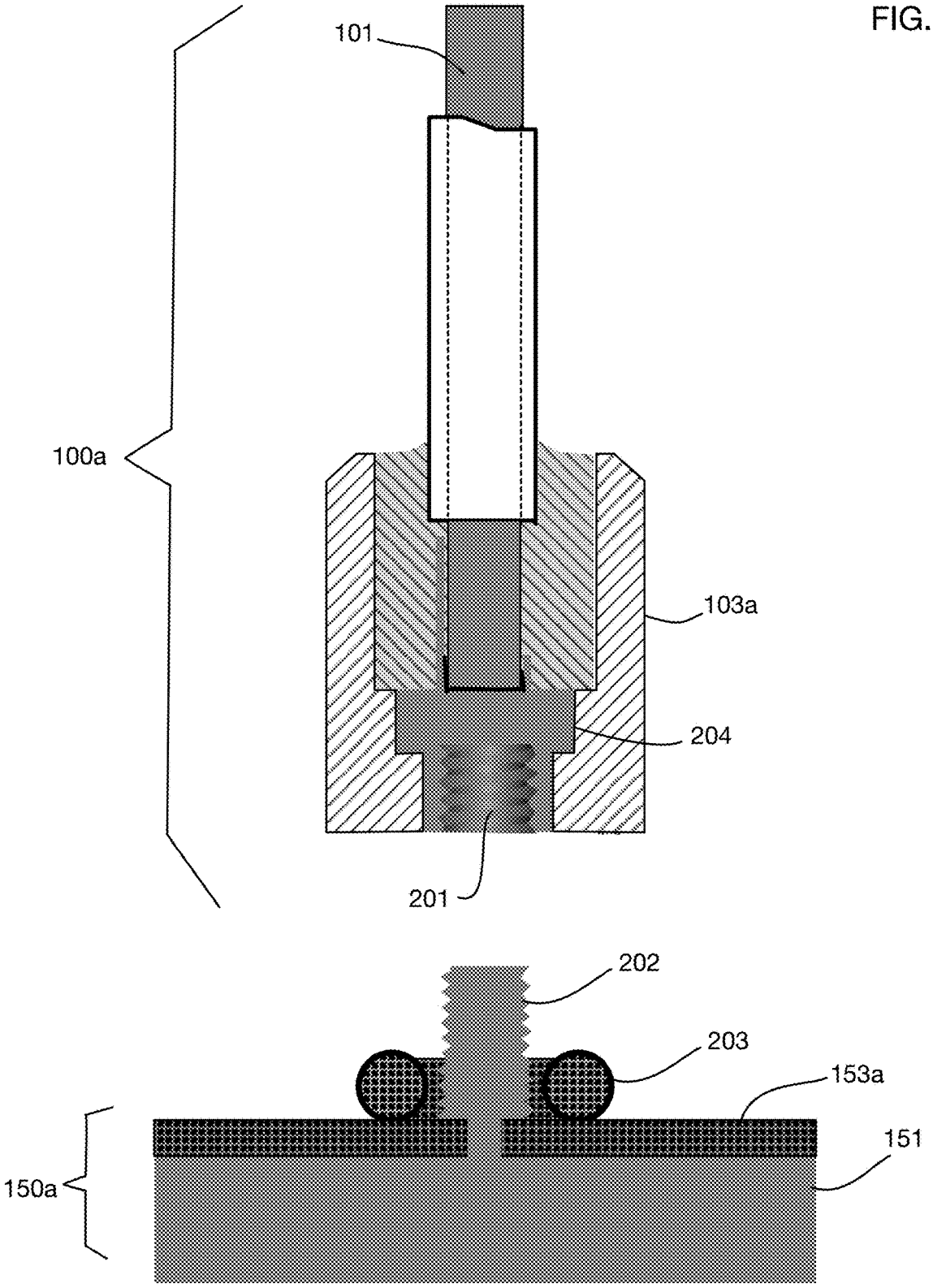
FIG. 2 shows a cross sectional view of a variation of the embodiment of FIG. 1A with a threaded rod protruding from the receiver block instead of from the connector attached to the conductor.

FIG. 2 shows an alternative connection mechanism that may be used in one or more embodiments of the connection system. In this illustrative embodiment, a threaded conductive rod 202 extends from the conductive block 151 of receiver block 150*a*, through a hole in insulative layer 153*a*. This rod 202 is surrounded by an O-ring or equivalent seal 203. Cable 100*a* has a connector housing 103*a* that holds a conductive socket 204 that is coupled to the single conductive wire 101. This socket 204 has a threaded hole 201 that receives threaded rod 202 to form a connection. When rod 202 is screwed into hole 201, O-ring 203 forms a waterproof seal between the cable 100*a* and the receiver block 150*a*.

One or more embodiments of the connection system may rearrange the components of FIG. 1A or FIG. 2 in various ways. For example, O-ring 203 may be attached to housing 103*a* instead of to receiver block 150*a*. In one or more embodiments the cable jacket 102 and the housing 103 may be integrated into a single component. In one or more embodiments the wire 101 and the threaded rod 104 may be integrated into a single component. Additional or alternative sealing mechanisms and materials may be added to either the housing or the receiver block to provide a waterproof connection. The shapes and sizes of the components are illustrative and may be modified as needed for various applications.

Figure 3:
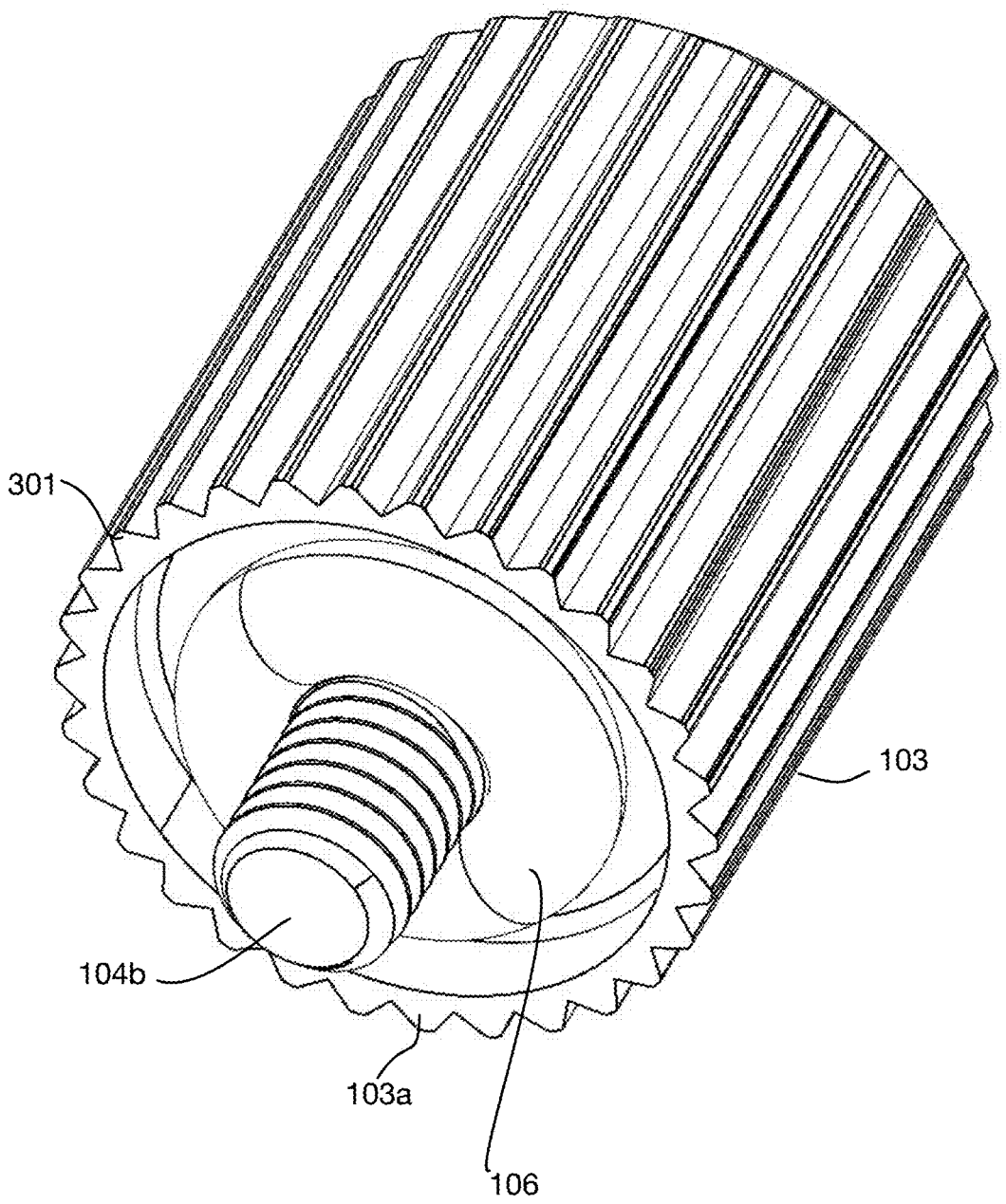
FIG. 3 shows a view of an embodiment of a connector housing, viewed from the end that attaches to the receiver block.
Figure 4:
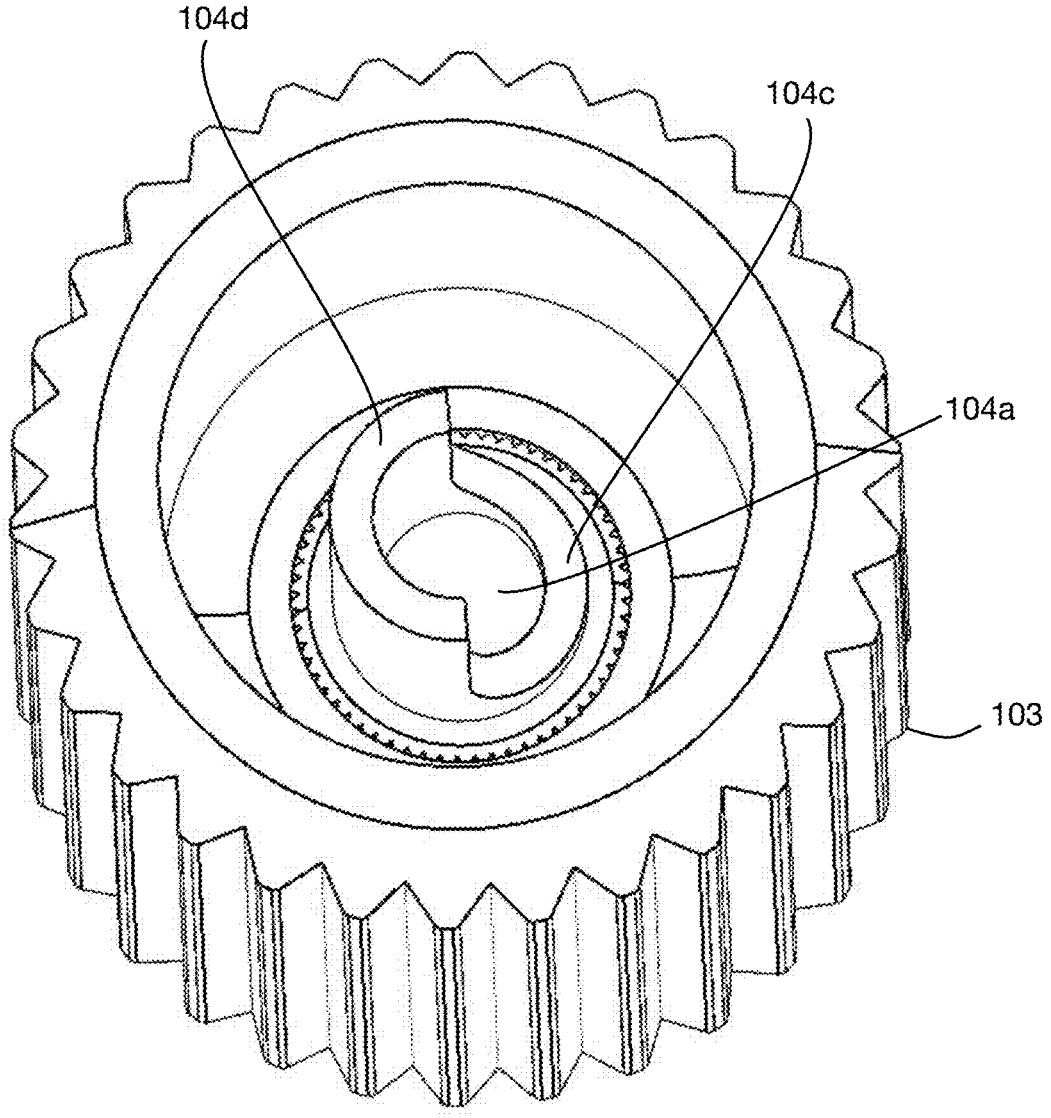
FIG. 4 shows the connector housing of FIG. 3 as viewed from the end that attaches to the wire.
Figure 5:
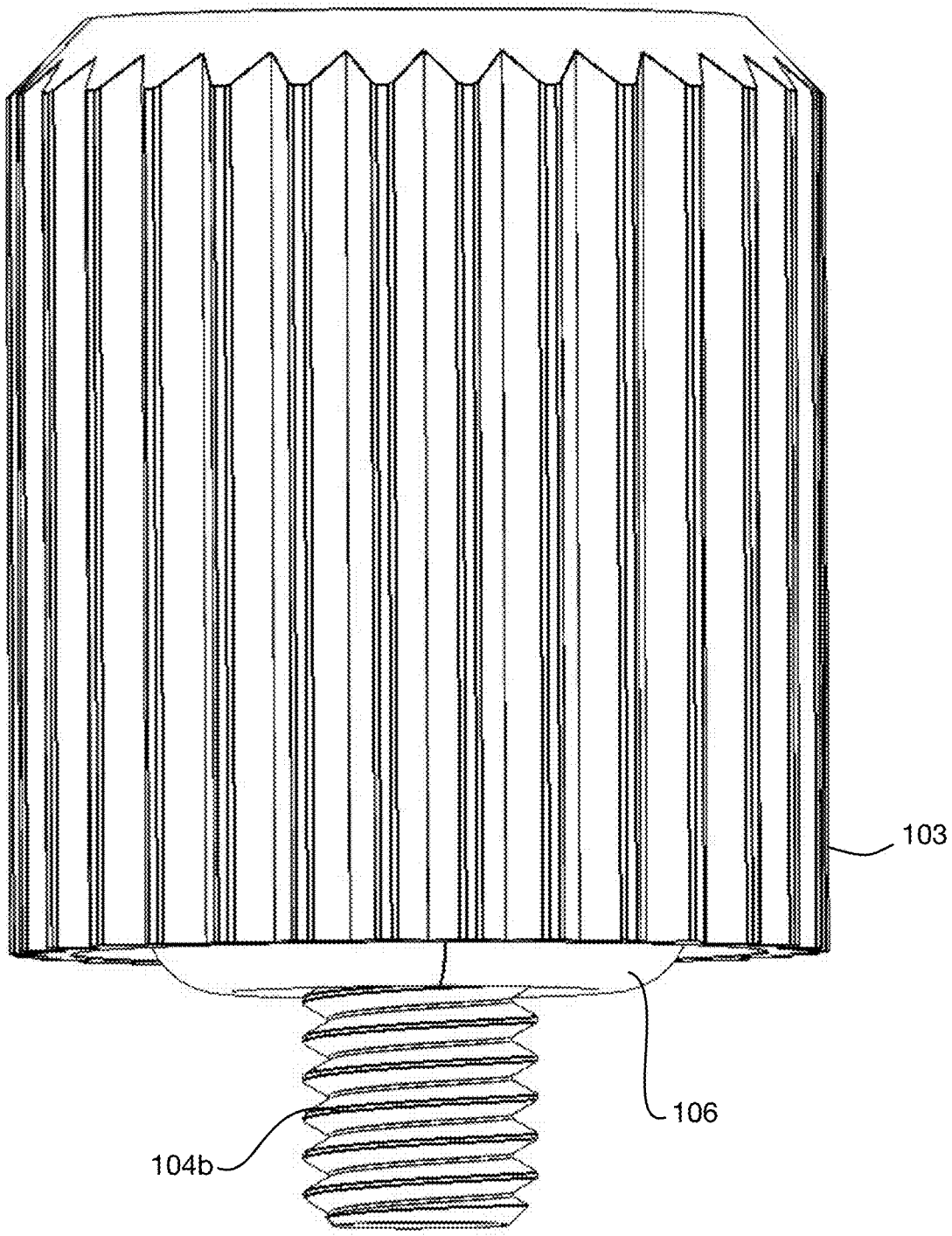
FIG. 5 shows a side view of the connector housing of FIG. 3.

FIGS. 3, 4, and 5 show different views of an embodiment of a housing, threaded rod, and O-ring. The wire, jacket, and receiver block are not shown in these views for ease of illustration, but may be present in a complete connection system. The embodiment shown is similar to the embodiment of FIG. 1A. FIG. 3 shows a view of the housing from the receiver-facing end. In this illustrative embodiment, the housing 103 has ridges such as ridge 301 to facilitate gripping the housing to screw or unscrew the threaded rod into or out of the receiver block. One or more embodiments may include any mechanism or mechanisms to assist in connecting or disconnecting, such as for example materials that facilitate gripping, or shapes or attachments that allow tools to be used to connect or disconnect the cable and housing and the receiver block. FIG. 3 shows the threaded rod end 104*b*, which protrudes beyond the receiver-facing end 103*a* of housing 103. It also shows O-ring 106 that surround threaded rod 104*b*.

FIG. 4 shows a view of the same embodiment, viewed from the wire-facing end. The top of the wire-facing end 104*a* of the threaded rod is shown, as well as the sides 104*c* and 104*d* of the solder cup that receives the wire of the cable. FIG. 5 shows a side view of this embodiment, also showing the housing 103, the threaded rod 104*b* protruding beyond the end of the housing, and the O-ring 106 surrounding the threaded rod.

Figure 6:
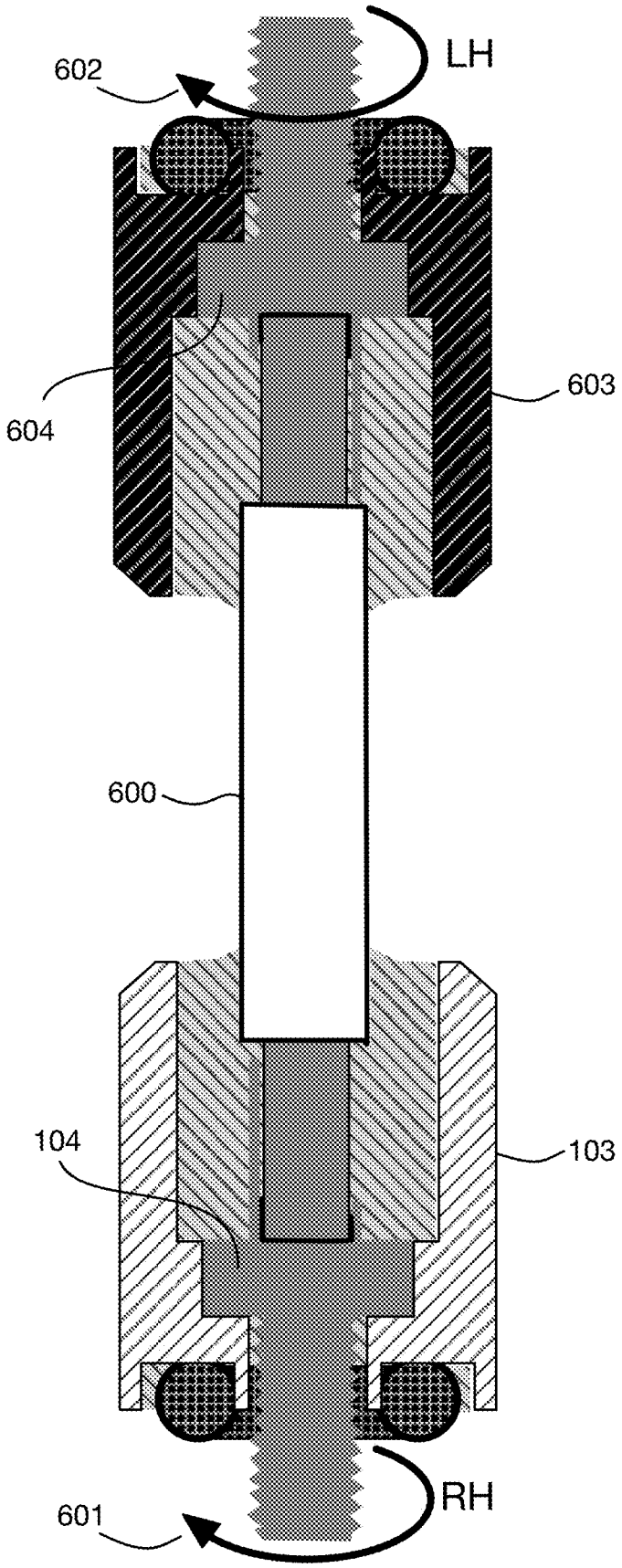
FIG. 6 shows a cross sectional view of a variation of the cable and connector of FIG. 1A, with screw connectors on both sides of the cable; the two screw connectors have opposite handedness to prevent excessive twisting of the cable when both ends are connected or disconnected.

In one or more embodiments, a housing and connector such as those illustrated in FIG. 1A may be attached at both ends of a cable. FIG. 6 shows an illustrative embodiment with housing 103 and threaded rod 104 attached to one end of cable 600, and housing 603 and threaded rod 604 attached to the other end of cable 600. Housing 103 and threaded rod 104 may be for example as described with respect to FIG. 1A. Housing 603 may be of similar or identical size and shape to housing 103 in one or more embodiments. Similar or identical O-rings or other seals may be present around the threaded protrusions of both threaded rods. Threaded rod 604 may be similar to threaded rod 104; however, in one or more embodiments the threads of rod 104 and the threads of rod 604 may be of opposite handedness. For example, threads of rod 104 may have right-handed orientation 601 and threads of rod 604 may have left-handed orientation 602, or vice-versa. A benefit of having threads of opposite handedness on the two ends of the cable is that tightening or loosening both connectors causes twists in the cable 600 to cancel out, minimizing twist accumulation in the cable. In one or more embodiments, housings may be color-coded or otherwise marked or altered to indicate the handedness of the threads; for example, in FIG. 6 the housing 603 is shaded a dark shade to indicate that threaded rod 604 is left-handed, and housing 103 is shaded a light shade to indicate that threaded rod 104 is right-handed. In two-cable connections, as illustrated below, a standard for polarity may be associated with a certain thread handedness, to ensure that polarity between two sides of a connection is never mismatched.

Figure 7:
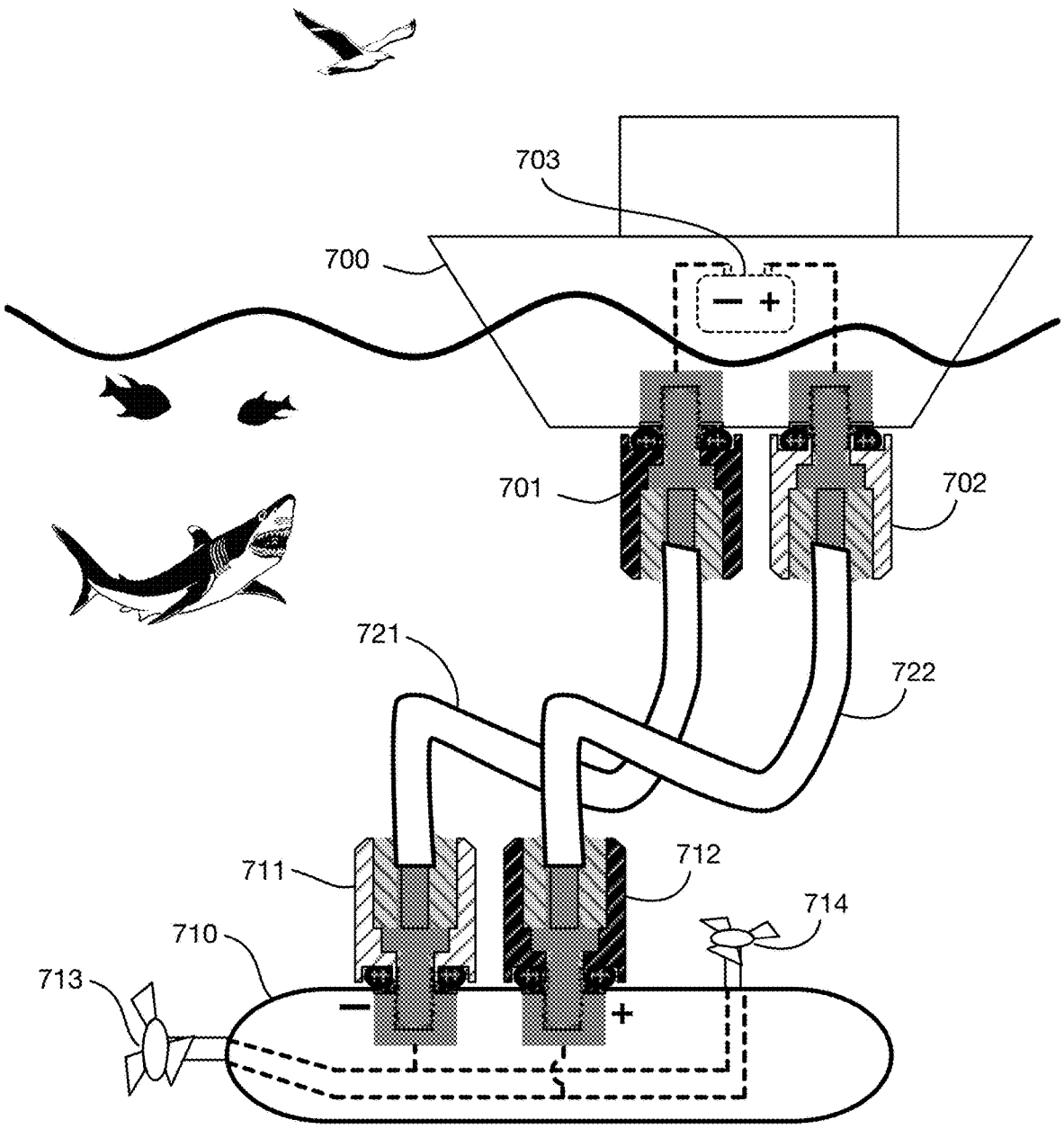
FIG. 7 shows an illustrative application of an embodiment of a connection system, which provides an underwater connection to supply power from a ship to an underwater drone.

FIG. 7 shows an illustrative application of a connection system, using the cable embodiment of FIG. 6 and the receiver block embodiment of FIG. 1A. In this application, two cables 721 and 722 carry power from a power source 703 on a ship 700 to an underwater drone 710, to power two devices 713 and 714 on the drone. Two cables are needed to form a complete power circuit because each cable includes only a single conductor. All connections are underwater; the waterproof connections between the cable ends and the corresponding receiver blocks ensure that water does not reach the conductive paths through the cables and the receiver blocks. In this illustrative example, the positive polarity connection to the power source 703 in the ship is made with right-handed and light-shaded connector 702, and the negative polarity connection to the power source 703 is made with left-handed and dark-shaded connector 701. Connections to the drone 710 have the opposite convention: the positive polarity connection to the drone is made with left-handed and dark-shaded connector 712, and the negative polarity connection to the drone is made with right-handed and light-shaded connector 711. These connection and polarity conventions are illustrative; one or more embodiments may use any conventions to make connections between any endpoints.

Figure 8:
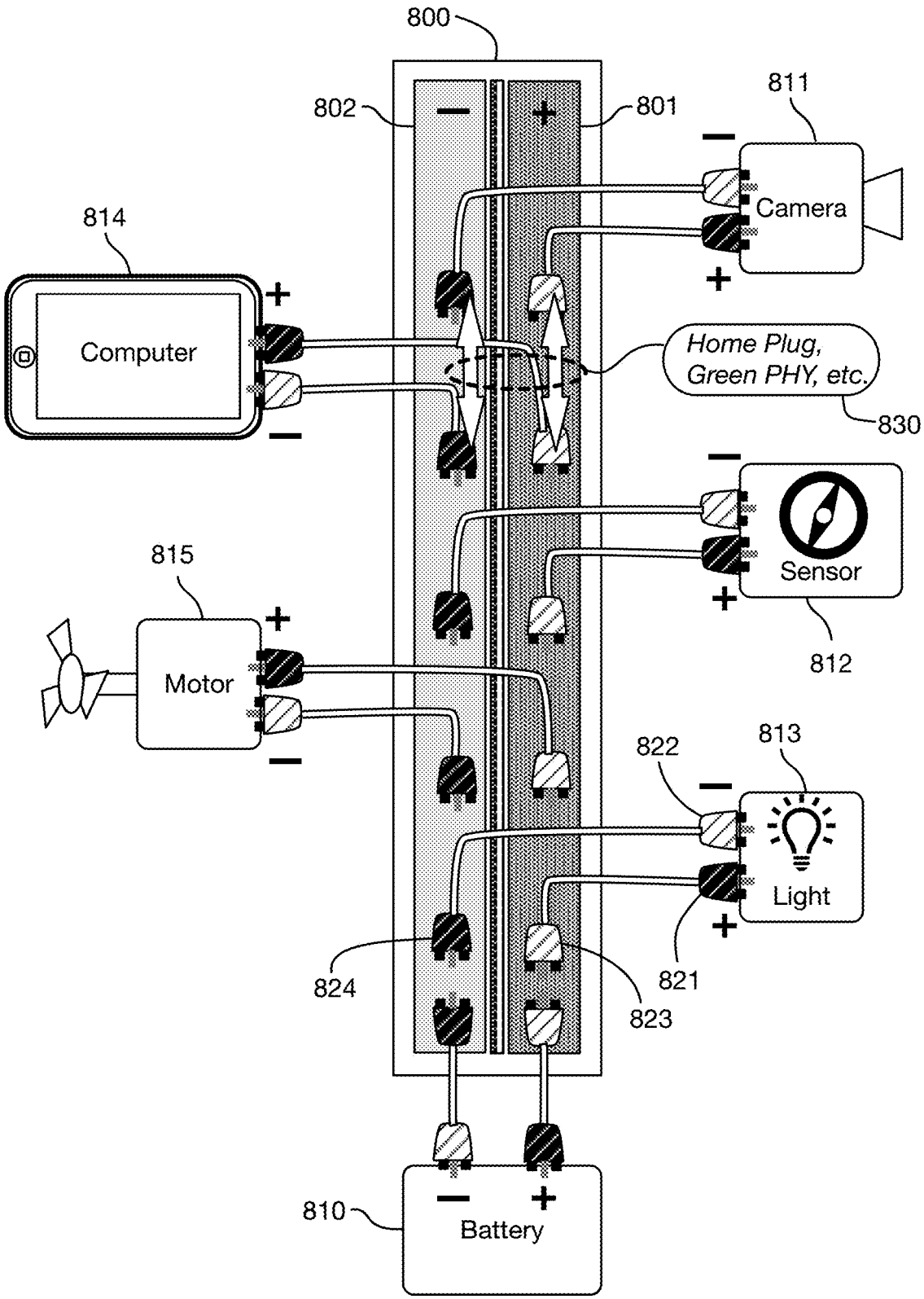
FIG. 8 shows an embodiment of a hub into which multiple devices can be connected using pairs of single conductor cables, each with two opposite-handed screw-in connectors; the hub may provide either or both of power distribution and inter-device communication.

One or more embodiments of a connection system may include a hub into which connections to multiple devices may be attached, providing robust, waterproof, high current connectivity for either or both of power and signals among devices. FIG. 8 shows an illustrative hub 800 with connections to devices 810, 811, 812, 813, 814, and 815. The cables connecting devices to the hub may be for example similar to the cable of FIG. 6, with threaded connectors of opposite handedness on both ends. Connecting a device to the hub 800 may for example involve attaching two cables, one to a threaded hole in negative receiver block 802 and the other to a threaded hole in positive receiver block 801. Positive receiver block 801 and negative receiver block 802 are electrically isolated. These two receiver blocks may each have multiple threaded holes to receive the threaded connectors of the cables; each hole may be similar to the threaded hole 152 of FIG. 1A. The two receiver blocks may also have insulative layers covering the corresponding conductive blocks to provide waterproof connections, such as insulative layer 153 of FIG. 1A. Each device may also have two receiver blocks, each with a threaded hole to receive a screw connector; each may be similar for example to receiver block 150 of FIG. 1A. In this example, the polarity and handedness convention is that positive polarity connections to the hub are right-handed (light-shaded), and negative polarity connections to the hub are left-handed (dark-shaded); connections to devices have the opposite convention, with positive polarity connections to a device being left-handed (dark-shaded), and negative polarity connections to a device being right-handed (light-shaded). For example, light 813 has a left-handed receiver block to receive positive connector 821, and a right-handed receiver block to receive negative connector 822; the opposite ends of the cables attached to the light are right-handed connector 823 connected to the positive receiver block 801 of the hub, and left-handed connector 824 connected to the negative receiver block 802 of the hub. This convention is illustrative; one or more embodiments may use any convention for the handedness of connections to the hub or to the devices. In one or more embodiments, a hub may have more than two receiver blocks; for example, if power and signals are carried on separate channels, a hub with four receiver blocks may be used.

The receiver blocks of the hub may be connected to a power source, such as battery 810, so that devices may be powered from their connections to the hub. Alternatively or in addition, communication signals between or among devices may be transmitted via the hub. If both power and signals are transmitted on the same channels via the hub and via the cable connections to devices, then any technology that multiplexes power and signals over the same channels may be used. For example, hub 800 of FIG. 8 may provide power from battery 810 to all of the devices 811, 812, 813, 814, and 815. It may also provide a data communications path 830 between or among devices, such as between camera 811 and computer 814. Communications protocols for data exchange may be for example Home Plug, Green PHY, or any other protocol that transmits signals over power channels. Communications may be one to one between devices, or may involve broadcasting or multicasting to several devices. In one or more embodiments a hub such as hub 800 may be used exclusively for data communications and not for power distribution. If a hub is used for power, it may be connected to any power source, including but not limited to a battery or an AC power source.

In one or more embodiments, multiple hubs such as hub 800 may be connected together. Inter-hub connections may for example use jumper cables with identical connectors on both sides of the cable (unlike the hub-to-device connection cables of FIG. 8, which have opposite handedness on opposite ends of the cables). Power may be distributed from a single power source to all devices on all connected hubs. Devices may communicate within and across hubs.

While the invention herein disclosed has been described by means of specific embodiments and applications thereof, numerous modifications and variations could be made thereto by those skilled in the art without departing from the scope of the invention set forth in the claims.

What is claimed is:

1. A waterproof single-conductor connection system comprising:

a cable comprising
- a single wire, wherein
  - said cable does not comprise a second wire different from said single wire; and
  - said single wire comprises a first end section, a second end section, and a middle section between said first end section and said second end section;
- a jacket coaxial with said single wire that surrounds said middle section of said single wire, wherein
  - said jacket comprises a waterproof, electrically-insulating material; and
- a connector at a first end of said cable, comprising
  - a housing coupled non-rotatably to said jacket, wherein
    - said housing has a wire-facing end and a connecting end;
    - said housing comprises a waterproof, electrically-insulating material;
    - said wire-facing end of said housing is coupled to said jacket with a waterproof joint; and
    - said housing surrounds said first end section of said wire;
  - a conductive threaded rod coupled non-rotatably to said single wire and to said housing, wherein
    - said conductive threaded rod has a wire-facing end and a connecting end;
    - a coupling between said single wire and said wire-facing end of said conductive threaded rod is located within said housing; and
    - said connecting end of said conductive threaded rod extends from said connecting end of said housing; and
  - an O-ring located on said connecting end of said housing, wherein said connecting end of said conductive threaded rod extends through said O-ring; and, a receiver block configured to be detachable coupled to said connector, comprising
- a conductive block having a threaded hole configured to mate with said connecting end of said conductive threaded rod; and
- an insulative layer coupled to a face of said conductive block that faces said connector when attached, wherein
  - said insulative layer comprises a waterproof, electrically-insulating material; and
  - said insulative layer has a hole over said threaded hole of said conductive block; and, wherein
- said connector is configured to couple detachably to said receiver block via insertion of said conductive threaded rod through said hole in said insulative layer and into said threaded hole of said conductive block, and via rotation of said housing to screw said conductive threaded rod into said threaded hole of said conductive block, which compresses said O-ring against said insulative layer of said receiver block, to form a waterproof seal.

2. The system of claim 1 wherein said wire, said conductive threaded rod, and said conductive block are each configured to transmit at least 4 amperes of current.

3. The system of claim 1 wherein said jacket, said housing, said O-ring, and said insulative layer are configured to provide protection of electrically conducting elements of said system against ingress of water when said system is submerged in water.

4. The system of claim 3 wherein said jacket, said housing, said O-ring, and said insulative layer are configured to provide protection of electrically conducting elements of said system against ingress of water when said system is submerged in water to a depth of 100 meters.

5. The system of claim 1 wherein said cable further comprises a second connector at a second end of said cable opposite said first end of said cable, said second connector comprising a second housing coupled non-rotatably to said jacket, wherein
- said second housing has a wire-facing end and a connecting end;
- said second housing comprises a waterproof, electrically-insulating material;
- said wire-facing end of said second housing is coupled to said jacket with a waterproof joint; and
- said second housing surrounds said second end section of said wire;

a second conductive threaded rod coupled non-rotatably to said single wire and to said second housing, wherein
- said second conductive threaded rod has a wire-facing end and a connecting end;
- a coupling between said single wire and said wire-facing end of said second conductive threaded rod is located within said second housing;
- said connecting end of said second conductive threaded rod extends from said connecting end of said second housing; and
- threads of said conductive threaded rod are right-handed and threads of said second conductive threaded rod are left-handed or
- threads of said conductive threaded rod are left-handed and threads of said second conductive threaded rod are right-handed; and, a second O-ring located on said connecting end of said second housing, wherein said connecting end of said second conductive threaded rod extends through said second O-ring.

6. The system of claim 5 wherein said second housing has a different color from said housing.

7. The system of claim 5 wherein said second housing has a different shape or a different texture from said housing.

8. The system of claim 5, further comprising a hub comprising said receiver block and a second receiver block, wherein said conductive block of said receiver block has a plurality of threaded holes, each configured to mate with a conductive threaded rod of a corresponding cable;

said insulative layer of said receiver block has a plurality of holes, each over a corresponding threaded hole of said conductive block;

said second receiver block comprises a second conductive block that has a second plurality of threaded holes, each configured to mate with a conductive threaded rod of a corresponding cable;

a second insulative layer coupled to a face of said second conductive block, wherein said second insulative layer has a second plurality of holes, each over a corresponding threaded hole of said second conductive block;

said second insulative layer comprises a waterproof, electrically-insulating material;

said conductive block and said second conductive block are separated by a non-conductive space or element; and, threads of said plurality of threaded holes are right-handed and threads of said second plurality of threaded holes are left-handed or threads of said plurality of threaded holes are left-handed and threads of said second plurality of threaded holes are right-handed.

9. The system of claim 8, wherein said receiver block and said second receiver block are both configured to transmit at least 4 amperes of current.

10. A waterproof single-conductor connection system comprising:

a plurality of cables, each cable of said plurality of cables comprising a single wire, wherein said cable does not comprise a second wire different from said single wire; and said single wire comprises a first end section, a second end section, and a middle section between said first end section and said second end section;

a jacket coaxial with said single wire that surrounds said middle section of said single wire, wherein said jacket comprises a waterproof, electrically-insulating material;

a first connector at a first end of said cable, comprising a first housing coupled non-rotatably to said jacket, wherein said first housing has a wire-facing end and a connecting end;

said first housing comprises a waterproof, electrically-insulating material;

said wire-facing end of said first housing is coupled to said jacket with a waterproof joint; and said first housing surrounds said first end section of said wire;

a first conductive threaded rod coupled non-rotatably to said single wire and to said first housing, wherein said first conductive threaded rod has a wire-facing end and a connecting end;

a coupling between said single wire and said wire-facing end of said first conductive threaded rod is located within said first housing; and said connecting end of said first conductive threaded rod extends from said connecting end of said first housing; and a first O-ring located on said connecting end of said first housing, wherein said connecting end of said first conductive threaded rod extends through said first O-ring;

a second connector at a second end of said cable opposite said first end of said cable, comprising a second housing coupled non-rotatably to said jacket, wherein said second housing has a wire-facing end and a connecting end;

said second housing comprises a waterproof, electrically-insulating material;

said wire-facing end of said second housing is coupled to said jacket with a waterproof joint; and said second housing surrounds said second end section of said wire;

a second conductive threaded rod coupled non-rotatably to said single wire and to said second housing, wherein said second conductive threaded rod has a wire-facing end and a connecting end;

a coupling between said single wire and said wire-facing end of said second conductive threaded rod is located within said second housing; and said connecting end of said second conductive threaded rod extends from said connecting end of said second housing; and a second O-ring located on said connecting end of said second housing, wherein said connecting end of said second conductive threaded rod extends through said second O-ring;

wherein said wire, said first conductive threaded rod, and said second conductive threaded rod are each configured to transmit at least 4 amperes of current;

threads of said first conductive threaded rod are right-handed;

threads of said second conductive threaded rod are left handed; and, said first housing has a different color, shape, or texture from said second housing;

a hub comprising a first receiver block comprising a first conductive block;

a first insulative layer coupled to a face of said first conductive block;

wherein said first conductive block has a first plurality of threaded holes;

said first insulative layer has a first plurality of holes, each over a corresponding threaded hole of said first plurality of threaded holes;

said first insulative layer comprises a waterproof, electrically-insulating material;

each threaded hole of said first plurality of threaded holes is configured to mate with a corresponding first conductive threaded rod of a cable of said plurality of cables;

threads of each threaded hole of said first plurality of threaded holes are right-handed; and, said first conductive block is configured to transmit at least 4 amperes of current;

a second receiver block comprising a second conductive block;

a second insulative layer coupled to a face of said second conductive block;

wherein said second conductive block has a second plurality of threaded holes;

said second insulative layer has a second plurality of holes, each over a corresponding threaded hole of said second plurality of threaded holes;

said second insulative layer comprises a waterproof, electrically-insulating material;

each threaded hole of said second plurality of threaded holes is configured to mate with a corresponding second conductive threaded rod of a cable of said plurality of cables;

threads of each threaded hole of said second plurality of threaded holes are left-handed; and, said second conductive block is configured to transmit at least 4 amperes of current;

wherein said conductive block and said second conductive block are separated by a non-conductive space or element.

11. The system of claim 10, further comprising:

a plurality of device receiver blocks, each configured to be coupled electrically to a device of a plurality of devices, wherein each device receiver block of said plurality of device receiver blocks comprises a conductive block;

an insulative layer coupled to a face of said conductive block;

wherein said conductive block has a threaded hole;

said insulative layer has a hole over said threaded hole;

said insulative layer comprises a waterproof, electrically-insulating material;

said conductive block is configured to transmit at least 4 amperes of current;

wherein each device of said plurality of devices is coupled electrically to a first device receiver block of said plurality of device receiver blocks, and a second device receiver block of said plurality of device receiver blocks;

threads of said threaded hole of said first device receiver block are right-handed; and threads of said threaded hole of said second device receiver block are left-handed;

said device is configured to be coupled detachably to said hub via a first cable of said plurality of cables and a second cable of said plurality of cables, wherein said first connector of said first cable is connected to said first device receiver block;

said second connector of said first cable is connected to a threaded hole of said second receiver block of said hub;

said second connector of said second cable is connected to said second device receiver block; and, said first connector of said second cable is connected to a threaded hole of said first receiver block of said hub.

12. The system of claim 11, wherein said plurality of devices connected to said hub comprise a power source; and, said hub and said plurality of cables are configured to transmit power from said power source to one or more devices of said plurality of devices.

13. The system of claim 12, wherein said hub and said plurality of cables are further configured to transmit data among two or more devices of said plurality of devices.

14. A waterproof single-conductor connection system comprising:

a cable comprising a single wire, wherein said cable does not comprise a second wire different from said single wire; and said single wire comprises a first end section, a second end section, and a middle section between said first end section and said second end section;

a jacket coaxial with said single wire that surrounds said middle section of said single wire, wherein said jacket comprises a waterproof, electrically-insulating material; and a connector at a first end of said cable, comprising a housing coupled non-rotatably to said jacket, wherein said housing has a wire-facing end and a connecting end;

said housing comprises a waterproof, electrically-insulating material;

said wire-facing end of said housing is coupled to said jacket with a waterproof joint; and said housing surrounds said first end section of said wire;

a conductive threaded socket coupled non-rotatably to said single wire and to said housing, wherein said conductive threaded socket has a wire-facing end and a connecting end;

a coupling between said single wire and said wire-facing end of said conductive threaded socket is located within said housing; and said conductive threaded socket has a threaded hole with an opening at said connecting end of said housing;

a receiver block configured to be detachable coupled to said connector, comprising a conductive block comprising a conductive threaded rod protruding from a face of said conductive block that faces said connector when attached, wherein said conductive threaded rod is configured to mate with said threaded hole of said conductive threaded socket;

an insulative layer coupled to said face of said conductive block that faces said connector when attached, wherein said insulative layer comprises a waterproof, electrically-insulating material; and said insulative layer has a hole through which said conductive threaded rod protrudes; and an O-ring located on said face of said conductive block that faces said connector when attached, wherein conductive threaded rod extends through said O-ring; and, wherein said connector is configured to couple detachably to said receiver block via insertion of said conductive threaded rod into said threaded hole of said conductive threaded socket, and via rotation of said housing to screw said conductive threaded socket onto said conductive threaded rod, which compresses said O-ring against said insulative layer of said receiver block, to form a waterproof seal.

* * * * *